US006299099B1

(12) United States Patent
Miller et al.

(10) Patent No.: US 6,299,099 B1
(45) Date of Patent: Oct. 9, 2001

(54) HYDRAULIC WEB ROLL SHAFT

(75) Inventors: William R. Miller, Portland; Semion Stolyar, Beaverton, both of OR (US)

(73) Assignee: Tidland Corporation, Camas, WA (US)

( * ) Notice: Subject to any disclaimer, the term of this patent is extended or adjusted under 35 U.S.C. 154(b) by 0 days.

(21) Appl. No.: 09/457,059

(22) Filed: Dec. 7, 1999

(51) Int. Cl.[7] ..... B65H 75/24
(52) U.S. Cl. ..... 242/529; 242/534
(58) Field of Search ..... 242/571, 571.3, 242/578, 529, 534, 596.5, 563.2

(56) References Cited

U.S. PATENT DOCUMENTS 3,797,772 * 3/1974 Lucas ..... 242/72.1
3,937,412 * 2/1976 Damour ..... 242/72 B
4,050,643 * 9/1977 Secor ..... 242/72 R
4,147,312 * 4/1979 Secor et al. ..... 242/72 R
4,195,792 * 4/1980 Hall ..... 242/72 B
4,465,244 * 8/1984 Karr ..... 242/72.1
4,911,376 * 3/1990 Thompson ..... 272/72.1
5,255,862 * 10/1993 Chenest ..... 242/72 R

* cited by examiner

*Primary Examiner*—Donald P. Walsh
*Assistant Examiner*—M. Beauchaine
(74) *Attorney, Agent, or Firm*—Chernoff, Vilhauer, McClung & Stenzel

(57) ABSTRACT

A web material roll rotatable retention assembly, comprising a shaft adapted to be inserted into a web material roll core and having a hydrogel filled chamber is disclosed. A hydrogel pressure applying assembly controllably applies pressure to the hydrogel and an outward pressure applying assembly pushes pressure applying members outwardly in response to the pressure of the hydrogel.

8 Claims, 9 Drawing Sheets

HYDRAULIC WEB ROLL SHAFT

BACKGROUND OF THE INVENTION

The present invention relates to web roll shafts having outwardly expansible pressure members that are driven by pressurized hydrogel.

In the web converting industry it is necessary to rotate large (sometimes more than 12 feet in diameter) rolls of web material. To achieve this end web material roll shafts and chucks are used which have a diameter smaller than the inner diameter of a web material roll core for easy insertion but which selectively expands after insertion so that they tightly grip the interior surface of the web material roll core.

The lugs or bladders that are pushed outwardly to create the selective expansion are typically pneumatically actuated. Although hydraulically actuated lugs could place more pressure against the inside surfaces of a web material roll core, hydraulics have typically been avoided in the processing of web materials because of the threat of a hydraulic fluid leak. Such a leak could easily ruin an entire role of paper or other porous web material because the centrifugal force exerted by the web material roll rotation could press the typically oily hydraulic fluid through many layers of web material. Moreover, such a leak could remain undiscovered until the fluid had leaked through to the exterior layer of web material, thereby ruining, for example, an entire roll of paper.

Unfortunately, the limits that the use of pneumatics place on the amount of pressure that can be applied to the inside of a web material roll core, places a limit on the acceleration and deceleration that a chuck may undergo without causing the web material roll to slip. Moreover, the desirability of applying high pressure to the expansion lugs leads to the placement of large pneumatic structures as part of each chuck assembly, because a large diaphragm (or piston) surface area is required to apply a high pressure when using pneumatics, due to elasticity of air, which is far greater than the elasticity of hydraulic fluid. The large structure needed to support a large diaphragm, however, acts as a fly wheel to the rotating chuck, placing an additional limit on the maximum acceleration and deceleration capabilities of the chuck.

An additional problem found in web material production and conversion facilities is that caused by the removal of a pair of chucks from either side of a web material roll. As the chucks are retracted, it is not uncommon for the web material roll to slide off of one chuck before sliding off of the other, simply due to the unpredictable frictional pull of each chuck. When this happens it is possible that the chuck upon which the roll remains will be damaged by the torque applied by the weight of the web material roll. Even if the chuck does not sustain damage some extra labor is needed at that point to remove the web material roll from the chuck to which it remains mounted. This disrupts the smooth flow of web material mill operations.

An additional problem encountered in the use of web material roll shafts is the variability of load demand on the expandable lugs. When a web material roll is close to empty not much lug pressure is needed to maintain control over the roll. On the other hand, too much pressure could burst the web material roll core. When the roll is full, just the opposite set of demands is encountered. A great deal of pressure must be applied to the interior of the roll core to maintain control over rotation and prevent the roll from slipping about the shaft. Moreover, there is little danger of bursting a full roll because of the many layers of web material that reinforce the central core.

What is therefore needed but not yet available is a web material roll shaft with expandable lugs that can be pressed outwards with a force greater than that available with pneumatics yet does not require the bulky apparatus necessary with pneumatics, and does not involve the danger of damaging the web material on the roll that appears to be inherent with the use of hydraulics. Also needed but not yet available is a web material roll chuck that could be removed from the web material roll with certainty so that a pair of chucks could be removed simultaneously without fail. Additionally needed but not yet available is a web material roll chuck that could apply pressure to the inside of a web material roll that would not burst an empty roll but could accurately control a full roll.

BRIEF SUMMARY OF THE INVENTION

In a first preferred aspect, the present invention is a web material roll rotatable retention assembly, comprising a shaft adapted to be inserted into a web material roll core and having a gelatinous hydraulic fluid ("hydrogel") filled chamber, a hydrogel pressure applying assembly to controllably apply pressure to the hydrogel and an outward pressure applying assembly adapted to push pressure applying members outwardly in response to the pressure of the hydrogel.

In a separate preferred aspect the present invention is a web material roll chuck assembly that includes a sleeve and a chuck having expansion lugs and being radially disposed within the sleeve. Further, a chuck retraction assembly is adapted to push the chuck outwardly from the sleeve and to retract the chuck inwardly so that it is disposed within the sleeve to remove the chuck from an interior core of a web material roll.

In a further separate aspect, the present invention is a web material roll shaft assembly, comprising a shaft having a set of pressure applying members adapted to be pressed outwardly against an interior of a web material roll and an outward pressure applying assembly adapted to push said set of pressure applying members with an outward force to retain a web material roll. A web material roll mass determining assembly determines the mass of a web material roll disposed about said shaft and a pressure applying assembly control mechanism adapted to control said outward force in response to said web material roll mass determining assembly.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
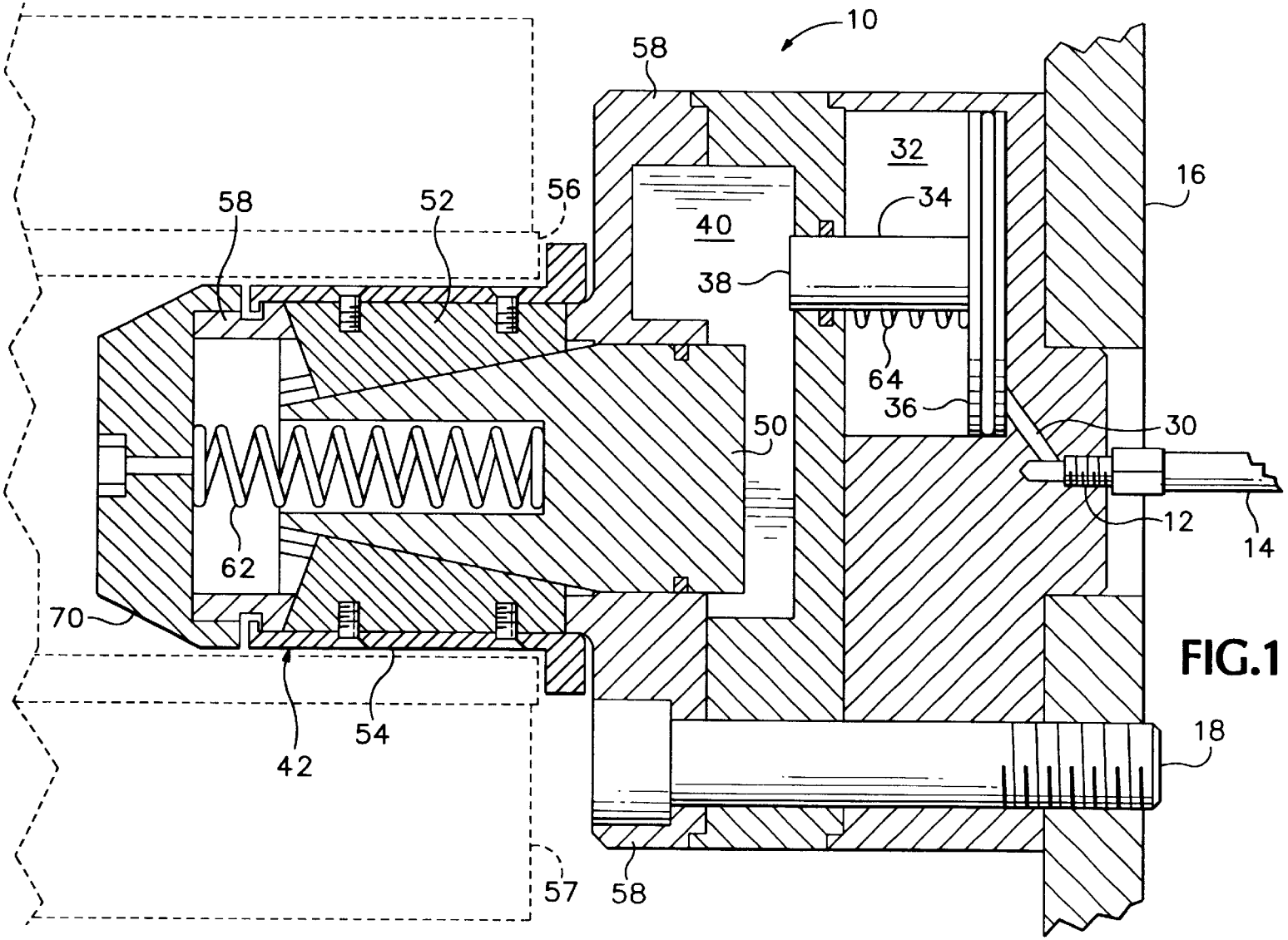
FIG. 1 is a cross-sectional view of a hydrogel web roll chuck according to the present invention.
Figure 2:
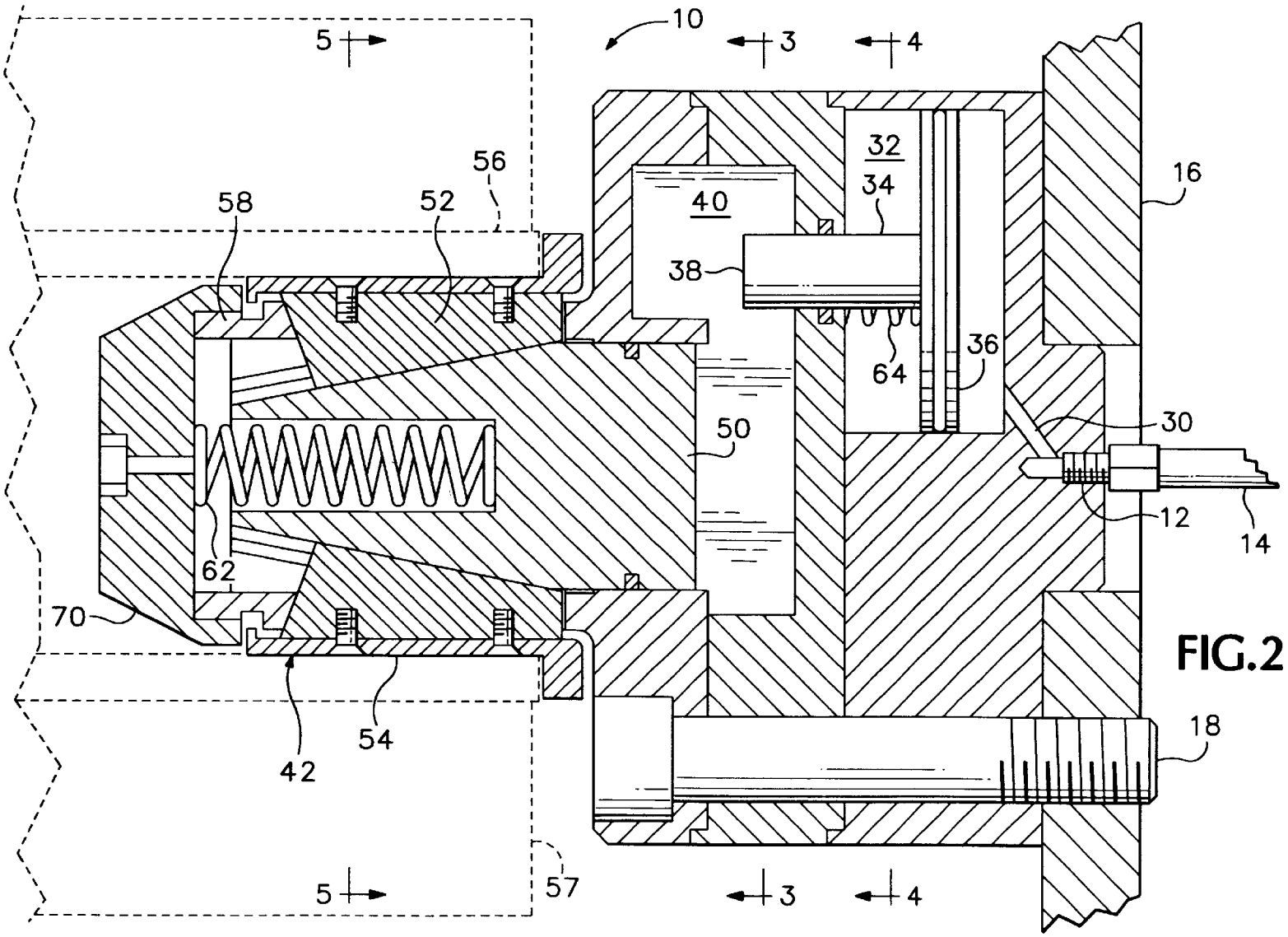
FIG. 2 is a cross-sectional view of the chuck of FIG. 1, with its lugs pressed outwardly against the interior of the web roll.
Figure 3:
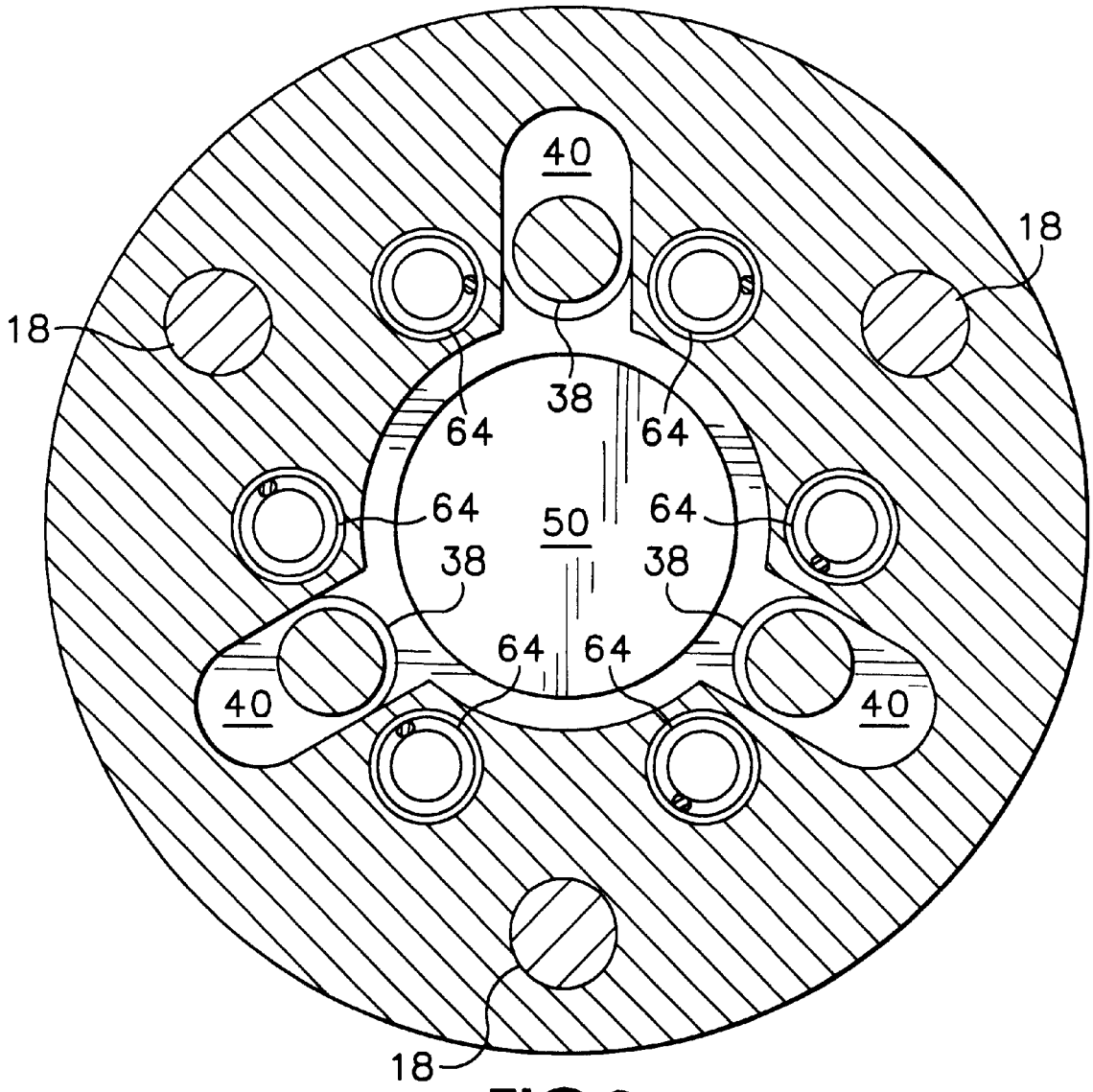
FIG. 3 is a cross-sectional view of the chuck of FIG. 1, taken along line 3—3 of FIG. 2.
Figure 4:
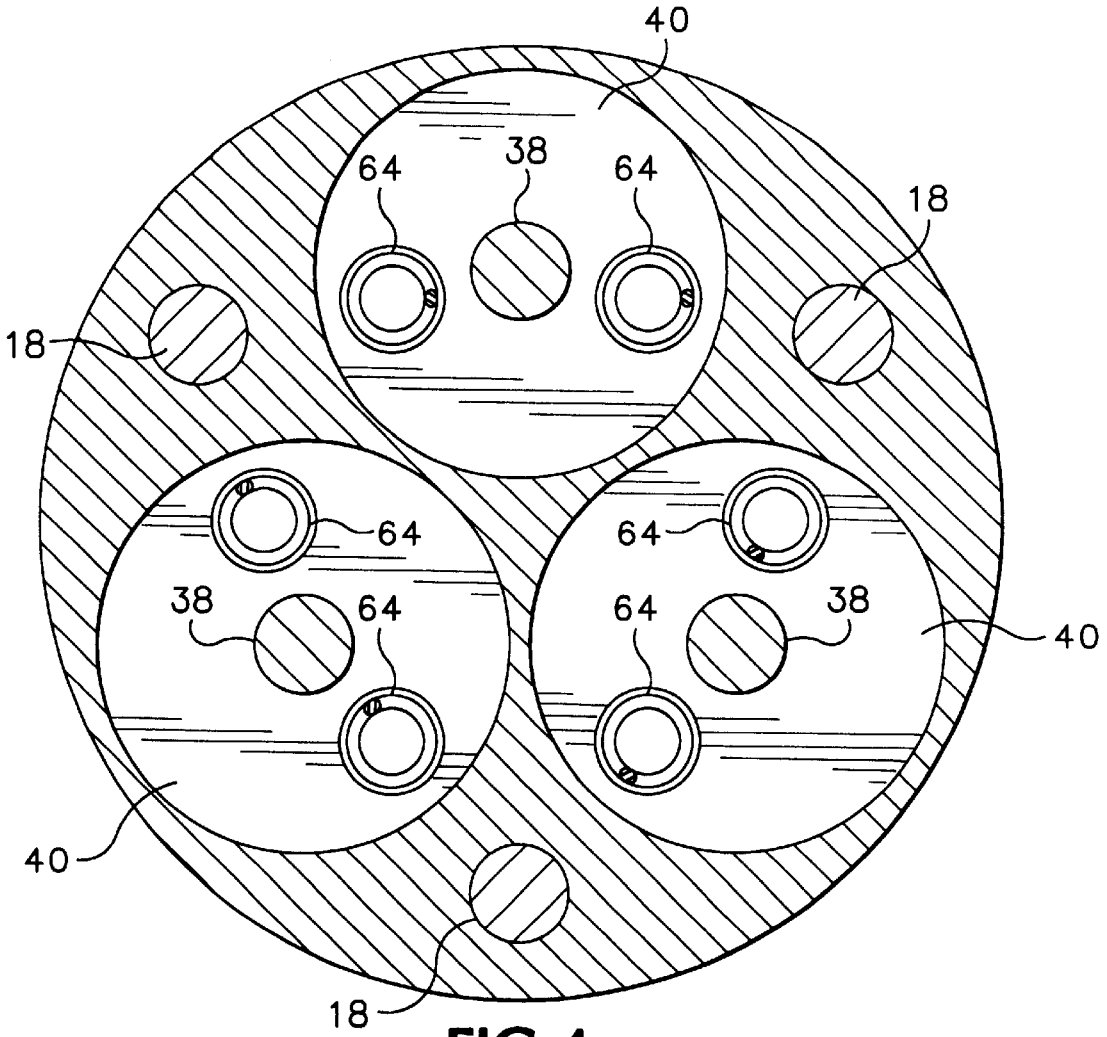
FIG. 4 is a cross-sectional view of the chuck of FIG. 1, taken along line 4—4 of FIG. 2.
Figure 5:
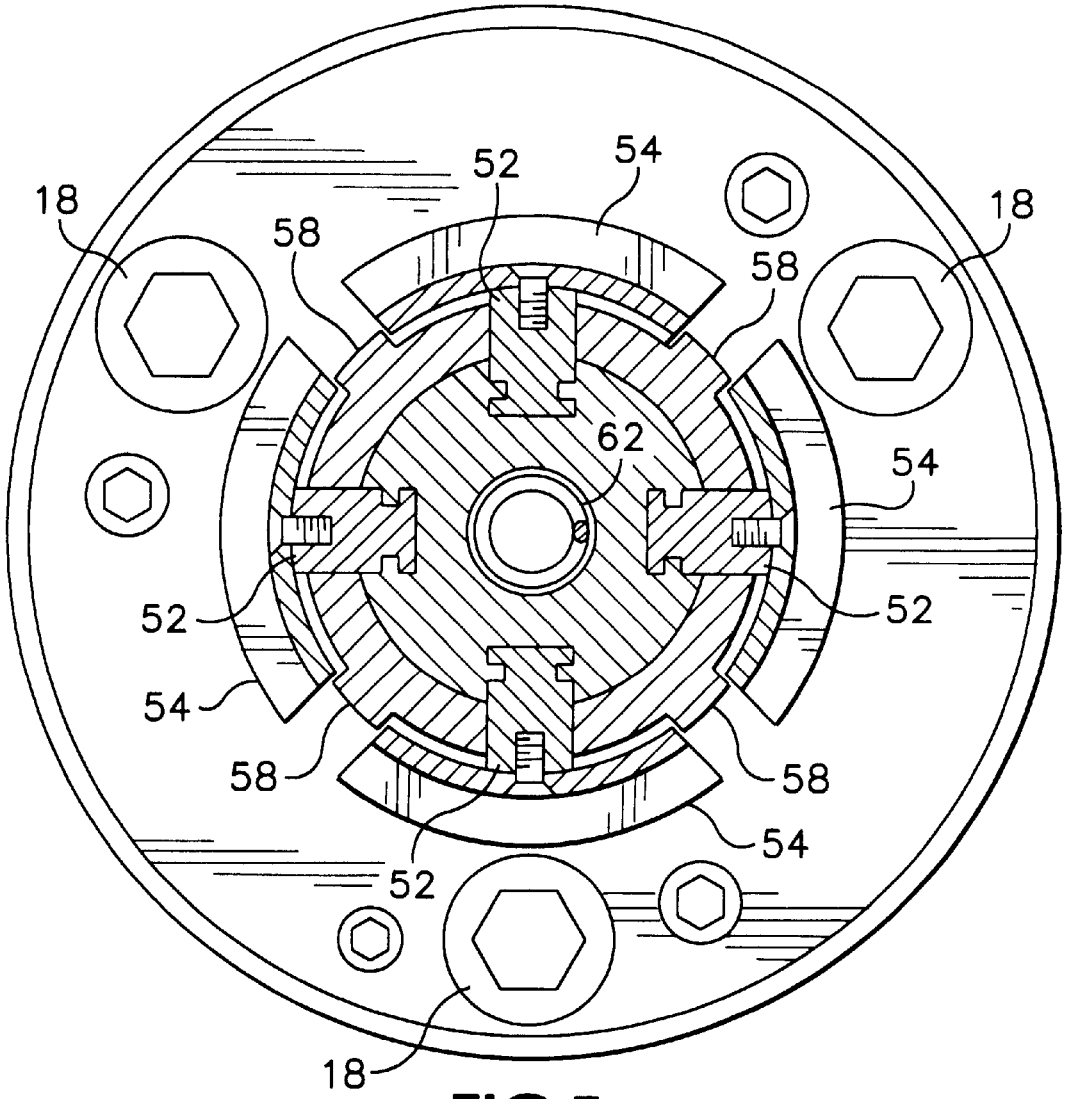
FIG. 5 is a cross-sectional view of the chuck of FIG. 1, taken along line 5—5 of FIG. 2.
Figure 6:
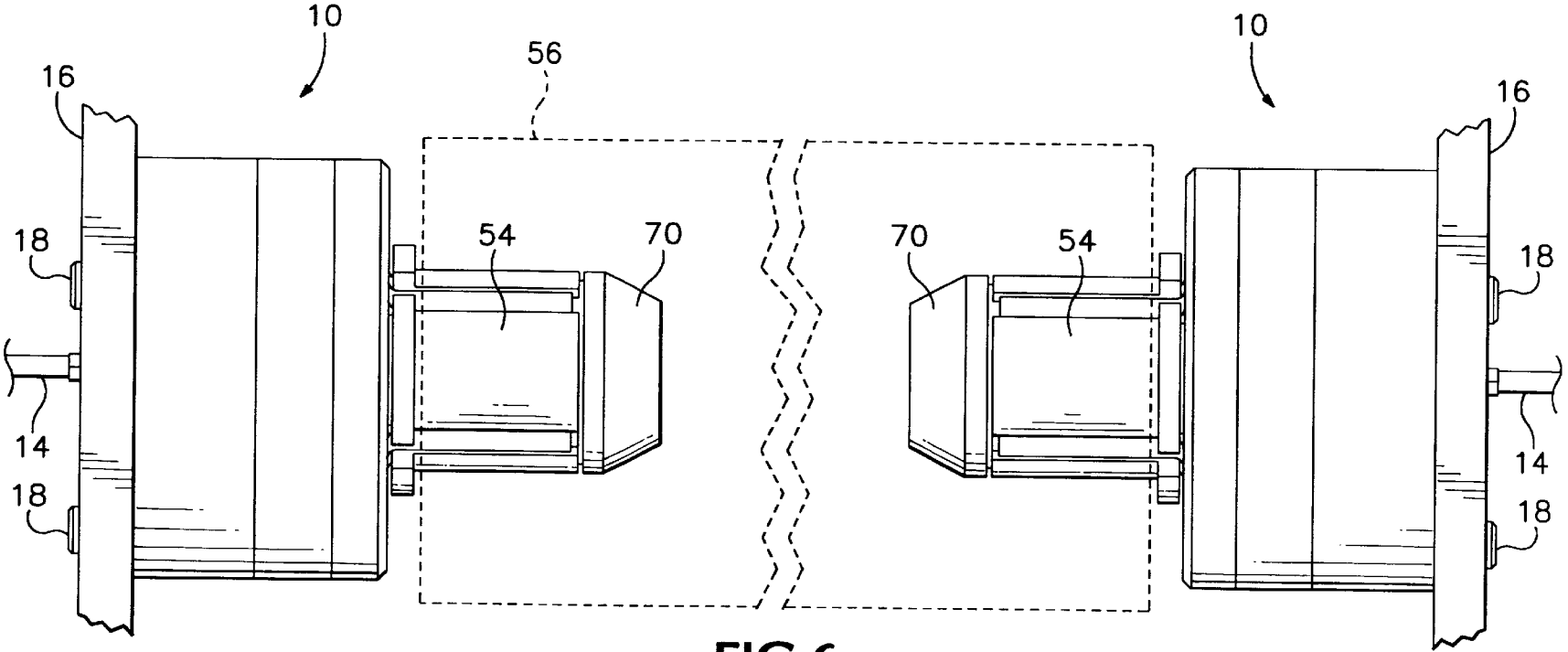
FIG. 6 is a plan view of two of the chucks of FIG. 1 stuck into a web roll.

Referring to FIGS. 1–6, a rotatable web material roll core retention assembly 10 constructed in accordance with the present invention includes a compressed air port 12. An air hose 14 is coupled to port 12 so that hose 14 may remain stationary while assembly 10 rotates. Assembly 10 attaches to a rotatable base plate 16 in part by way of a set of three bolts 18.

A set of three air passages 30 link port 12 to a set of three air filled cylinders 32 that each house a pressure amplifying piston 34 having a base 36 and a front end 38. Although assembly 10 includes three cylinders 32 it would be possible to design a web roll retention assembly, according to the present invention, having just one, two, or at the other extreme, many cylinders of the type represented by cylinders 32. Collectively, these elements form a hydrogel pressure applying assembly. As skilled persons will recognize the pressure amplification is proportional to the ratio of the area of piston base 36 with piston front end 38. The piston front end 38 enters a second chamber 40 that is filled with hydrogel. The relative inelasticity of the hydrogel makes practical the relatively small surface area of front end 38 and the concomitant high level of pressure amplification given by the small area of base 36, relative to what would be necessary in a purely pneumatic system. When the pistons 34 are pressed forward by compressed air, the hydrogel in the second chamber 40 transmits the pressure from piston front ends 38 to the base of a lug actuating piston 50 that protrudes into shaft or chuck 42. Lug actuating piston 50 then pushes against a set of pressure translating pieces 52 (collectively forming an outward pressure applying assembly) which, in turn press a set of lugs or pressure applying members 54 outwardly against a web roll core 56 that is the innermost element of a web roll 57. The pieces 52 are constrained in movement by a cylindrical housing 58 that accommodates pieces 52 in a set of slots. The housing 58 is rigidly attached to a chuck nose 70.

When the pressure of compressed air at port 12 is reduced a spring 62 pushes lug actuating piston 50 backwards, causing the hydrogel in chamber 40 to press the three pistons 34 backwards, in a motion aided by a set of six springs 64. The backwards movement of piston 50 permits the lugs 54 to retract thereby releasing core 56.

The advantage of this embodiment over the presently available entirely pneumatic systems is that greater force may be applied by lugs 54 against core 56. Because of this, faster acceleration and deceleration may be performed without inducing slippage between lugs 54 and core 56.

Figure 7:
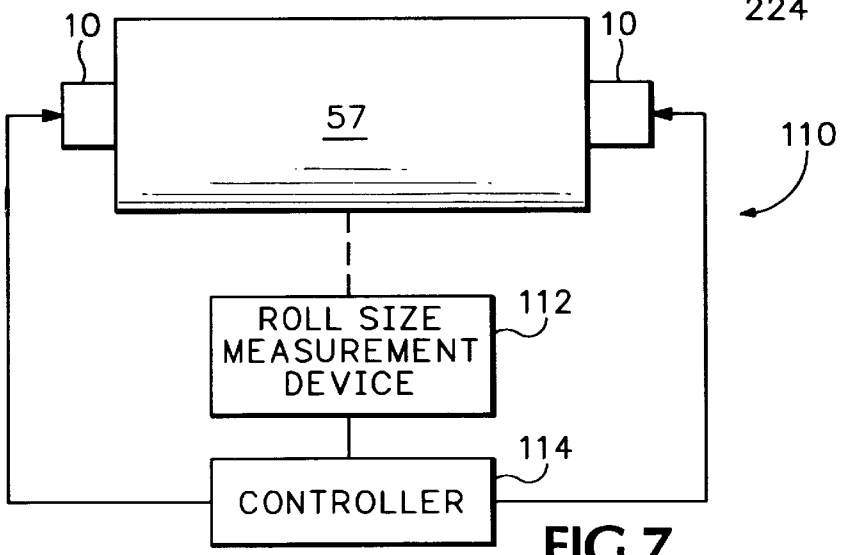
FIG. 7 is a block diagram of hydrogel web roll chuck lug pressure modulating system according to the present invention.

A lug pressure control system 110, shown in FIG. 7, is used to create maximum lug pressure when the web material roll 57 is full but to lower the amount of lug pressure when web material roll 57 is less full. When the web roll 57 is full it is also heaviest and therefore has the greatest inertia and requires the greatest torque for acceleration and deceleration. Maximum lug pressure prevents slippage under these maximum torque conditions. When roll 57 is less full, it does not have as much strength to resist the outward pressure of lugs 54 and could even suffer bursting if the lug pressure was too great.

A roll size measurement device 112 could include a laser range finder or a mechanical roll size measurement device. It could even be a device for weighing web material roll 57 and could be included as part of chuck 10. One particularly easy way to measure the size of the web roll is to examine the control signal to the web roll air brake that is already present in many prior art systems. This signal occurs in a feedback loop that maintains the web tension at a constant level. Because the air brake acts by way of the roll diameter as a lever arm, the control signal for the air brake is related to the web roll core diameter and may be used as a gauge of this diameter. Another simple way to measure the web roll core diameter is to enter the starting diameter and web thickness into a control terminal and then decrease the calculated web roll diameter by the number of revolutions times the web thickness. Whatever type of measurement device 112 is used, measurements from device 112, indicating the size of roll 57 are sent to a controller 114 which adjusts the amount of pressure applied by lugs 54 according to an algorithm which takes into account the amount of torque needed to move roll 57 and the anticipated strength of roll 57.

Figure 8:
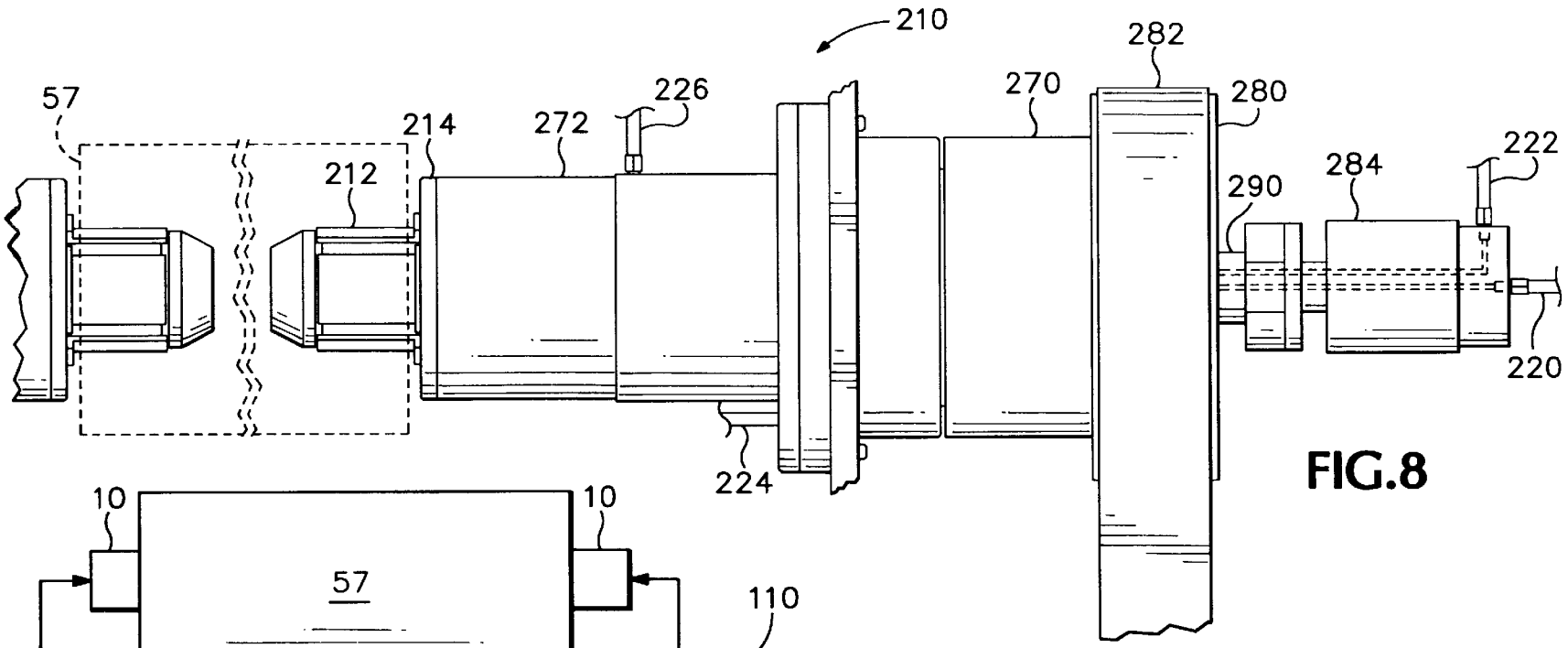
FIG. 8 is a plan view of a sleeve-retractable web core chuck according to the present invention.
Figure 9:
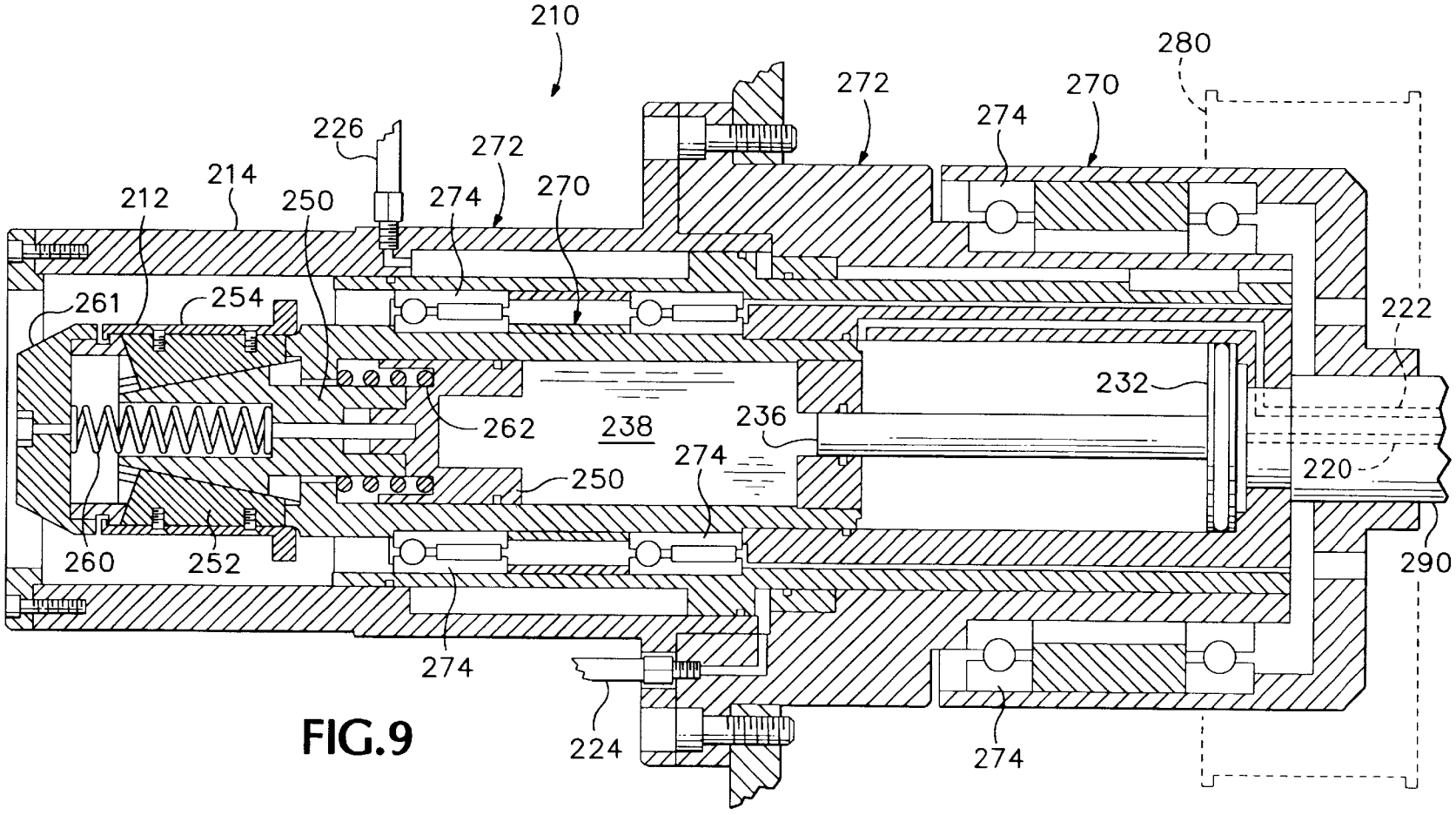
FIG. 9 is a cross-sectional of the web core chuck of FIG. 8.
Figure 10:
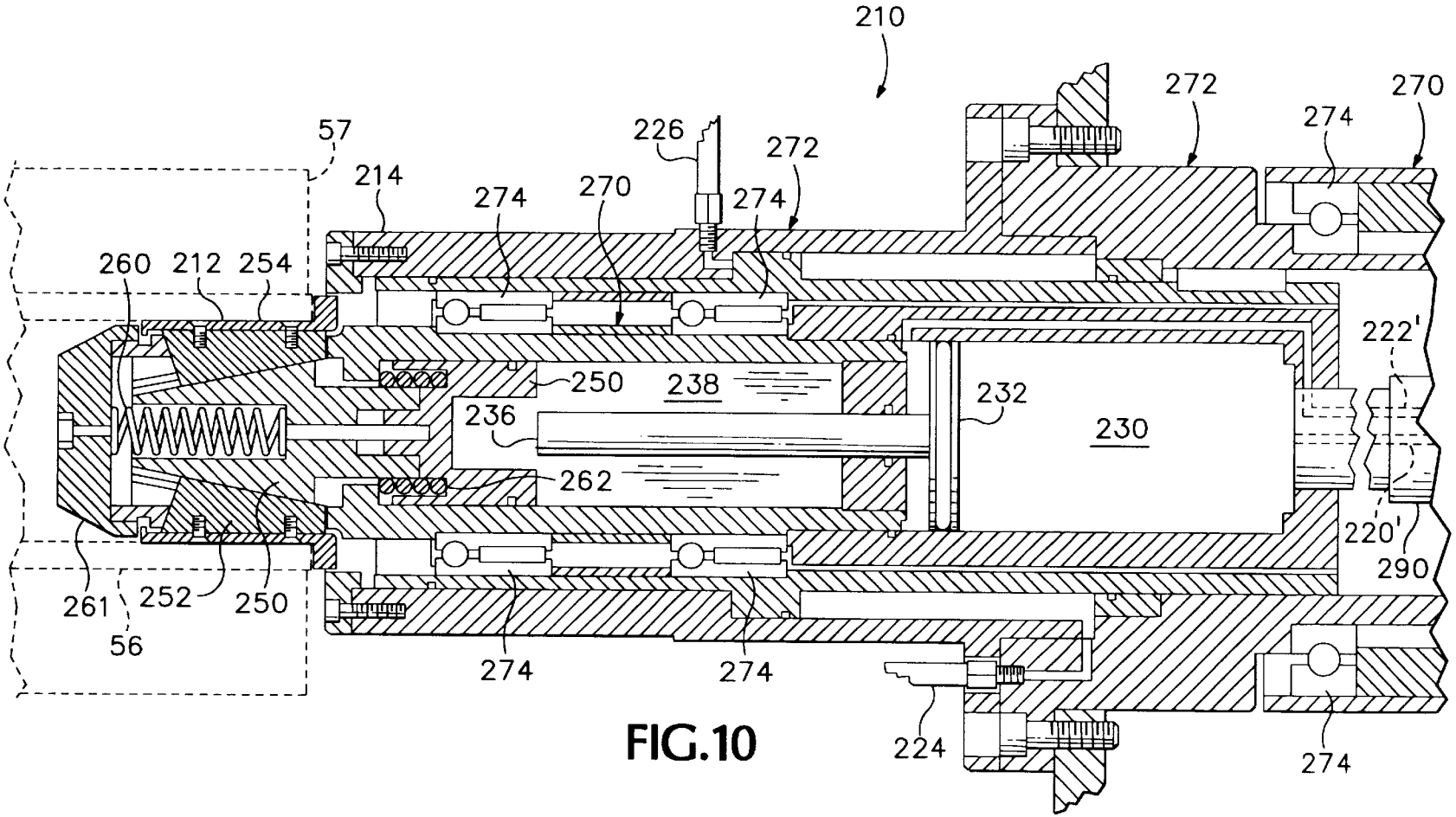
FIG. 10 is a cross-sectional of the web core chuck of FIG. 8, with its lugs pressed outwardly against a web roll.

Referring to FIGS. 8–10, a telescoping chuck assembly 210 includes a chuck 212 that is retractable into a sleeve 214 (FIG. 9 shows the retracted position). This design has the advantage that when chuck 212 is retracted into sleeve 214, the web roll 57 is affirmatively removed from chuck 212. Referring to FIG. 8, when two matching chucks 212 are simultaneously retracted into two sleeves 214, there is no danger of web material roll 57 remaining about a single one of the two chucks and potentially damaging that chuck, as may occur in prior art systems.

In order to accomplish its tasks, chuck assembly 210 includes four pneumatic ports: A lug compression compressed air port 220, a lug compression air exhaust port 222, a chuck advance compressed air port 224 and a chuck retraction compressed air port 226. When compressed air port 220 introduces air into an air cylinder 230 a pressure amplification piston 232 (FIGS. 9 and 10) is moved forward so that a piston shaft 236 is pushed into a hydrogel chamber 238. This forces a lug actuating piston 250 forward. This, in turn, forces a set of lug pressure pieces 252 to move outwardly and, in turn, press a set of lugs or pressure members 254 outwardly against a web roll core 56.

When the pneumatic pressure in air cylinder 230 is reduced a first chuck spring 260, mounted on a chuck nose 261, and a second chuck spring 262 force piston 250 backwards, which allows lugs 254 to retract and in turn forces piston 232 backwards.

Assembly 210 is divided between a rotatable subassembly 270 and a housing 272, that includes sleeve 214 and which rotatably supports subassembly 270. A set of bearings 274 permit the rotation of subassembly 270 within housing 272. Air pressure at port 224 forces the rotatable subassembly 270 forward, whereas air pressure at port 226 forces the rotatable subassembly 270 backwards. Ports 224 and 226, together with associated pressure chambers, form a chuck retraction assembly.

Rotatable subassembly 270 is turned by a pulley 280 that is driven by a belt 282 (FIG. 8). It should be noted that other power means could be used to drive subassembly 270. Lug compression air port 220 and lug compression exhaust port

222 are connected to rotatable subassembly 270 by way of a rotary air union 284, which permits the air pressure to be communicated from a nonrotating part to a rotating part. A telescoping spline shaft 290 telescopes outwardly to deliver compressed air to cylinder 230 when rotatable subassembly has 270 has been pushed forward. When rotatable subassembly is pushed back, spline shaft 290 telescopes inwardly.

A hydrogel that works to advantage in this application may be produced by mixing together and extruding at 300° F. the following proportions of ingredients (by weight): 21–25% PVC powder; 72–76% dibutylphthalate; and 3% calcium stearate.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A rotatable web material roll core retention assembly, comprising:

(a) a shaft adapted to be inserted into a web material roll core and having a chamber containing gelatinous fluid material, and a set of pressure applying members adapted to be pressed outwardly against a web material roll core;

(b) a first pressure applying assembly operable to controllably cause increasing pressure in said gelatinous fluid material without expanding said material; and (c) a second pressure applying assembly operable to retractably push said pressure applying members outwardly in response to said pressure in said gelatinous fluid material.

2. The retention assembly of claim 1 wherein said second pressure applying assembly includes a piston exposed to said gelatinous fluid material in said chamber for retractably pushing said pressure applying members outwardly.

3. The retention assembly of claim 1 wherein said first pressure applying assembly includes a piston assembly having at least one piston that is forced into said gelatinous fluid material by pneumatic pressure.

4. The retention assembly of claim 3 wherein said piston assembly includes multiple pistons that are forced into said gelatinous fluid material by pneumatic pressure.

5. The retention assembly of claim 3 wherein said piston assembly is operable as a pressure amplifier to apply a pressure greater than said pneumatic pressure to said gelatinous fluid material.

6. The retention assembly of claim 1 in which said shaft is in the form of a chuck that fits partially through a web material roll core from one end thereof.

7. The retention assembly of claim 6 wherein said chuck is within a sleeve, further including a chuck retraction assembly adapted to retract said chuck inwardly into said sleeve so as to positively remove said roll core from about said chuck.

8. The retention assembly of claim 1, further including a web material roll mass determining assembly operable to measure the mass of web material on said roll core, said first pressure applying assembly being operable to variably control said pressure in said gelatinous fluid material depending upon a measurement of said mass by said roll mass determining assembly.

* * * * *